US008829384B2

(12) United States Patent
Hartmann

(10) Patent No.: US 8,829,384 B2
(45) Date of Patent: Sep. 9, 2014

(54) GUIDING AND SHAPING SYSTEM

(75) Inventor: Manfred Hartmann, Wilnsdorf (DE)

(73) Assignee: Wuppermann Edelstahltechnik GmbH, Leverkusen (DE)

( * ) Notice: Subject to any disclaimer, the term of this patent is extended or adjusted under 35 U.S.C. 154(b) by 1541 days.

(21) Appl. No.: 11/920,313

(22) PCT Filed: May 11, 2006

(86) PCT No.: PCT/DE2006/000824

§ 371 (c)(1),
(2), (4) Date: Jun. 4, 2009

(87) PCT Pub. No.: WO2006/119755

PCT Pub. Date: Nov. 16, 2006

(65) Prior Publication Data

US 2009/0277879 A1 Nov. 12, 2009

(30) Foreign Application Priority Data

May 13, 2005 (DE) ..... 10 2005 022 244

(51) Int. Cl.

| | |
|---|---|
| ***B23K 9/00*** | (2006.01) |
| ***B23K 31/02*** | (2006.01) |
| ***B23K 11/00*** | (2006.01) |
| ***B21D 39/02*** | (2006.01) |
| ***B21D 5/08*** | (2006.01) |
| ***B21D 5/14*** | (2006.01) |
| ***B21D 5/12*** | (2006.01) |
| ***B21C 37/08*** | (2006.01) |

(52) U.S. Cl.

CPC .. *B21C 37/08* (2013.01); *B21D 5/12* (2013.01)
USPC ..... 219/78.16; 219/61.3; 219/59.1; 219/60 R; 219/60.2; 219/61; 219/67; 72/51; 72/52; 72/178; 72/181; 72/182

(58) Field of Classification Search

USPC ..... 219/7.16, 61.3, 59.1, 60 R, 60.2, 61, 219/678; 72/51, 52, 178, 181, 182

See application file for complete search history.

(56) References Cited

U.S. PATENT DOCUMENTS 1,570,452 A * 1/1926 Sjobring et al. ..... 219/59.1
1,922,913 A * 8/1933 Free et al. ..... 219/59.1

(Continued)

FOREIGN PATENT DOCUMENTS

DE 35 29 160 2/1987
DE 198 34 400 1/2000

(Continued)

OTHER PUBLICATIONS

Dreistern-Werk Maschinenbau GmbH & Co. KG company publication.

*Primary Examiner* — Dana Ross
*Assistant Examiner* — Gyounghyun Bae
(74) *Attorney, Agent, or Firm* — D. Peter Hochberg; Sean F. Mellino; Richard A. Wolf

(57) ABSTRACT

A guiding and shaping system for producing welded pipes made from metallic strip material. The guiding and shaping system comprises several pairs of rolls that are disposed one behind another in the direction of travel of the workpiece and are used for increasingly cold-working and bending the edges of the workpiece as the workpiece advances. First pairs of rolls grip the top side and bottom side of the workpiece while pairs of rolls that grip the external faces of the bent edges and form the shape of a pipe are provided in the region where the bent edges form undercuts. The guiding and shaping system further comprises a welding device. The workpiece is supported by floatingly mounted lateral rolls until cooling off following the welding process.

13 Claims, 3 Drawing Sheets

(56) References Cited

U.S. PATENT DOCUMENTS

| | | | | | |
|---|---|---|---|---|---|
| 1,982,415 | A | * | 11/1934 | Blevins | 219/61.13 |
| 2,177,104 | A | * | 10/1939 | Gonser | 413/1 |
| 2,196,106 | A | * | 4/1940 | Darner | 219/61.3 |
| 2,196,192 | A | * | 4/1940 | Broadfield | 228/220 |
| 2,354,267 | A | * | 7/1944 | Lytle et al. | 228/125 |
| 2,425,986 | A | * | 8/1947 | Bohm | 72/70 |
| 2,464,402 | A | * | 3/1949 | Kentis, Jr. | 219/110 |
| 2,549,173 | A | * | 4/1951 | Cogan | 219/61.3 |
| 2,762,902 | A | * | 9/1956 | Hankin | 219/59.1 |
| 3,014,118 | A | * | 12/1961 | Vassar | 219/59.1 |
| 3,065,328 | A | * | 11/1962 | Brown | 219/60 R |
| 3,242,301 | A | * | 3/1966 | Osborn, Jr. | 219/612 |
| 3,244,851 | A | * | 4/1966 | Thomas | 219/61.5 |
| 3,291,360 | A | * | 12/1966 | Linnander | 228/44.3 |
| 3,431,383 | A | * | 3/1969 | Ullery, Jr. et al. | 219/61.3 |
| 3,472,053 | A | * | 10/1969 | Chang | 72/178 |
| 3,578,165 | A | * | 5/1971 | Boose | 219/107 |
| 3,581,041 | A | * | 5/1971 | Balfanz, Jr. | 219/60 R |
| 3,601,570 | A | * | 8/1971 | Davis | 219/62 |
| 3,610,863 | A | * | 10/1971 | Doublet | 219/61.3 |
| 3,616,053 | A | * | 10/1971 | Fahrenbach | 156/355 |
| 3,648,007 | A | * | 3/1972 | Oppermann et al. | 219/61.3 |
| 3,988,913 | A | * | 11/1976 | Metcalfe et al. | 72/69 |
| 4,070,887 | A | * | 1/1978 | Hankin | 72/52 |
| 4,099,044 | A | * | 7/1978 | Blair et al. | 219/82 |
| 4,122,696 | A | * | 10/1978 | Midzutani et al. | 72/52 |
| 4,249,406 | A | * | 2/1981 | Anderson | 72/52 |
| 4,341,943 | A | * | 7/1982 | Nilsen | 219/121.64 |
| 4,354,085 | A | * | 10/1982 | George et al. | 219/59.1 |
| 4,595,815 | A | * | 6/1986 | Vere et al. | 219/58 |
| 4,697,446 | A | | 10/1987 | Yamamoto et al. | |
| 4,905,885 | A | * | 3/1990 | Hellman, Sr. | 228/144 |
| 5,461,896 | A | | 10/1995 | Abbey, III et al. | |
| 5,647,241 | A | * | 7/1997 | Ruple et al. | 72/178 |
| 6,545,246 | B2 | * | 4/2003 | Kummle | 219/121.63 |
| 7,748,597 | B2 | * | 7/2010 | Nicolai et al. | 228/151 |
| 2005/0082345 | A1 | | 4/2005 | Nicolai et al. | |
| 2007/0017268 | A1 | * | 1/2007 | Wang et al. | 72/78 |

FOREIGN PATENT DOCUMENTS

| | | |
|---|---|---|
| DE | 101 31 461 | 12/2002 |
| EP | 0 919 299 | 6/1999 |
| WO | WO 03/047783 | 6/2003 |

* cited by examiner

GUIDING AND SHAPING SYSTEM

CROSS-REFERENCE TO RELATED APPLICATIONS

This application is a National Stage application of International Application No. PCT/DE2006/000824, filed on May 11, 2006, which claims priority of German application number DE 10 2005 022 244.7, filed on May 13, 2005.

BACKGROUND OF THE INVENTION

Field of the Invention

The invention relates to a guiding and shaping system for producing welded pipes made from metallic strip material, in which the strip edge (seam) of the welded pipes is closed, for example, with the aid of a laser or by radiofrequency technology, to a method for producing welded pipes, and to the use of the guiding and shaping system to produce welded pipes.

The production of welded pipes made from metallic strip material is known (DE 35 29 160 A1). As a rule, in this case the initially strip-shaped workpiece (metallic strip material) is subjected in a cold state to an ever stronger shaping of the edges. The first pair of rolls in the feed direction in this case have somewhat interengaging shapes which bend the strip material so far that the bent edges are at somewhat more than a right angle to the previous cross section of the strip. At this degree of shaping, no further shaping roll can engage in the workpiece, which in this way has an undercut and is partially already shaped into a pipe.

It is therefore known, starting from such a degree of shaping, to provide at the outsides undriven rolls that press the bent up regions of the workpiece closer to one another in the further pass and complete the bending of the tube. However, this frequently leads to offsetting the two edges from one another, and this leads to inhomogeneities that must later be compensated.

In order to eliminate these inhomogeneities, it is known from DE 198 34 400 C1 to twist the partially shaped pipe in a first turning section by approximately a quarter turn, and to shape it further in this twisted position during the further feed in such a way that the slot located between the edges is reduced as it is further fed. However, the inhomogeneities are not avoided with this method.

A system for joining and longitudinally welding bent pipes made from sheets or the like is known from DE 101 31 461 C1. The sheets or tubes are mounted on rolls.

DE 35 29 160 A1 discloses a shaping rolling apparatus having movable carriages.

EP 0 919 299 A2 relates to an apparatus for removing a weld seam reinforcement.

WO 03/047783 A1 describes a method and an apparatus for changing the rolls in a pipe welding stand.

The pipes shaped and welded using the known methods burst easily, because stresses occur in the crystal structure of the welded tube. This effect is particularly marked for welded pipes.

SUMMARY OF THE PRESENT INVENTION

An object of the present invention is therefore an apparatus for welding pipes made from metallic strip material, in the case of which bursting of the pipes is avoided. The weld is to be executed in such a way that virtually no inhomogeneities occur. The design of the novel apparatus is to be so simple that it is easy to use.

There has been found a guiding and shaping system for producing welded pipes made from metallic strip material, comprising:

- a number of pairs of rolls, arranged one behind another in the feed direction of the workpiece, for increasingly cold-working and bending the edges of the workpiece as it is fed,
- the first pairs of rolls gripping the top side and underside of the workpiece, and providing in the region in which the bent edges form undercuts pairs of rolls that grip the outsides of the bent edges and form the shape of a pipe, and
- a welding apparatus, the workpiece being supported after welding by floatingly mounted lateral rolls until it cools.

In homogeneities of the welded pipe are largely excluded with the aid of the inventive guiding and shaping system. The pipes thus produced do not burst even under load. Requisite after-machining of the weld as known from EP 919299 A2 is eliminated.

In a preferred embodiment of the present invention, the system for guiding compression rolls and shaping slotted pipes which is intended for producing welded pipes made from metallic strip material can comprise:

- a number of rolls, arranged one behind another in the feed direction of the workpiece, for increasingly cold-working and bending the edges of the workpiece as it is fed, first pairs of rolls gripping the top side and underside of the workpiece, and there being provided in the region in which the bent edges form undercuts pairs of rolls that grip the outsides of the bent edges and form the shape of a pipe, and pairs of rolls being provided that grip the outsides of the bent edges and form a variable shape of a pipe and can be individually shaped, and
- a calibration apparatus for welding compression rolls, the welded pipe being held after welding by lateral rolls that are floatingly mounted until the welded pipe cools, where it also is possible to influence the slotted pipe and the corresponding seam position with the aid of a central adjustment to the 3 compression rolls arranged in the shape of a star such that the entire pipe guiding system can be set with the aid of only a mechanical adjusting unit (automatically by motor, or manually) such that the seam position before and during the welding process can fundamentally always be automatically or else manually adjusted in an optimum welding position, and
- a welding torch guide that can be aligned with corresponding radial guides in a centric fashion relative to the pipe axis and always remains at an exactly equal radius and spacing from the material, even in the event of tracking, when readjustment is performed automatically or manually.

Thus, it is fundamentally possible for material to penetrate equally at the slotted pipe irrespective of the particular radial position in which the system or the slotted pipe is located. Likewise, the distance between welding system and pipe remains fundamentally exactly the same, and this stands out, in particular, in the case of a more highly qualified and more demanding laser welding through the focal distance, which is always the same. This renders it possible for the first time also to introduce a regulated welding process on a slotted pipe.

In the guiding and shaping system according to the invention, welding can be carried out using all the conventional methods for closing strip edges (seams) in metallic materials. Particular mention may be made of tungsten inert-gas welding (TIG welding), laser welding, HF-welding or all other methods of welding procedures.

As in the case of all other welding methods for pipes, the flat strip is formed into the pipe in the profiling machine during TIG welding. At the welding area, an arc burns in an envelope of shielding gas made from inert gas (argon/helium/hydrogen mixture or pure argon) between a nonmelting tungsten cathode and the strip edges. A number of cathode torches are used in order to raise the weld rate or in the case of pipes of relatively large dimension. Direct or alternating current is used depending on the application (company publication from Dreistern-Werk Maschinenbau GmbH & Co. KG).

The most important advantage of laser welding is the outstanding seam quality. The weld rate is generally also higher than in the case of TIG welding. However, the effect of heating the pipe material is substantially less than in the case of TIG welding.

In the case of laser welding, a strongly focused light beam of nondivergent light is directed onto the weld point. The light beam is produced in an optical resonator that comprises two mirrors and two parallel RF electrodes. The entire energy of the laser is concentrated on a point of approximately 0.25 mm. This leads to an extreme energy density of over 3 million $W/cm^2$. As a rule, a vapor channel with ionized metal gas forms at the weld point. The temperature is approximately 25,000° C. A melt zone is formed around the vapor channel. The sheet strip shaped into the pipe is moved through under the laser beam. A continuous weld is formed as a result (company publication from Dreistern-Werk Maschinenbau GmbH & Co. KG).

In accordance with the present invention, the pipe, preshaped in a known way from metallic strip material, with open edges (slotted pipe) is introduced into the inventive guiding and shaping system in which the still open edges are closed with the aid of a known welding apparatus.

Metal strips (coils) made from stainless steel, sheet, copper and brass, preferably stainless steel, may be mentioned as metallic strip materials.

After being welded, the pipe is supported according to the invention between floatingly mounted lateral rolls arranged downstream of the welding apparatus in the feed direction, until it cools.

Floatingly mounted lateral rolls are to be understood in the context of the present invention as rolls that virtually only guide the pipe without pressure and exclude bending and/or torsional forces.

A preferred embodiment of the present invention is characterized in that the floatingly mounted lateral rolls act in a selfcentering fashion for the pipe.

In accordance with the present invention, the workpiece is supported by floatingly mounted lateral rolls until it cools. According to the invention, cooling preferably takes place down to a temperature in the region of around room temperature. As a result, the formation of a dendritic microstructure of the melt in the solidification state is counteracted, or it is suppressed.

In a particular refinement of the present invention, during cold working before welding all the guide rolls and compression rolls of the workpiece can be adjusted by central height adjustment and central lateral adjustment.

According to the invention, the height adjustment and lateral adjustment can be performed by mechanical or electronic apparatuses.

When shaping the pipe from the metal strip with the aid of the compression rolls, different thicknesses of the material easily occur, depending on the metal used.

In accordance with the invention, these can be compensated by eccentrically adjusting the compression rolls.

In a particular embodiment of the present invention, the compression rolls are connected by levers, for adjusting purposes, to an eccentric cam.

A further particular embodiment of the present invention relates to adjusting the pipe, shaped into a slotted pipe, for the purpose of introducing it into the welding apparatus.

Adjusting the welding apparatus to the edges of the still open pipe can be performed mechanically.

In the particularly preferred embodiment within the scope of the present invention, however, the adjusting of the welding apparatus relative to the edges of the still open pipe is performed by an optical strip edge detection system. The position of the weld torch relative to the open edges is controlled according to the invention via the optical strip edge detection system.

Optical strip edge detection systems are known.

A method for producing welded pipes made from metallic strip material has also been found which is characterized in that the initially flat strip material is cold-formed into a pipe in a number of forming stations lying one behind another in the conveying direction, this being done by the edges of the strip material being more and more bent over and bent toward one another by compression rolls and guide rolls, the slot present between the edges being reduced in the further course of the feed and the shaping and finally being closed and welded, it being possible for the workpiece to be set variably in the shape of a star by in the angle of inclination and, in addition, to adjust the height of the compression rolls individually in each case and also to adjust them eccentrically in relation to one another.

Consequently, the strip edges can be held against one another precisely and calibrated even if different material thicknesses or material geometries are welded to one another. The bearing pressures can respectively be regulated separately and controlled electronically per compression roll such that irregularities in the strip widths accompanied by a resulting basic cross section of the pipes to be shaped that is deviant are likewise automatically eliminated. Furthermore, the possibility is thereby provided of optimizing the forces on each workpiece edge or wall thickness to the extent that there is an optimum melting process irrespective of which welding technique is used.

The subject matter of the present invention is also the use of a guiding or shaping system for producing welded pipes made from metallic strip material.

DETAILED DESCRIPTION OF THE PRESENT INVENTION

The present invention can be explained with reference to FIGS. 1 to 3.

Figure 1:
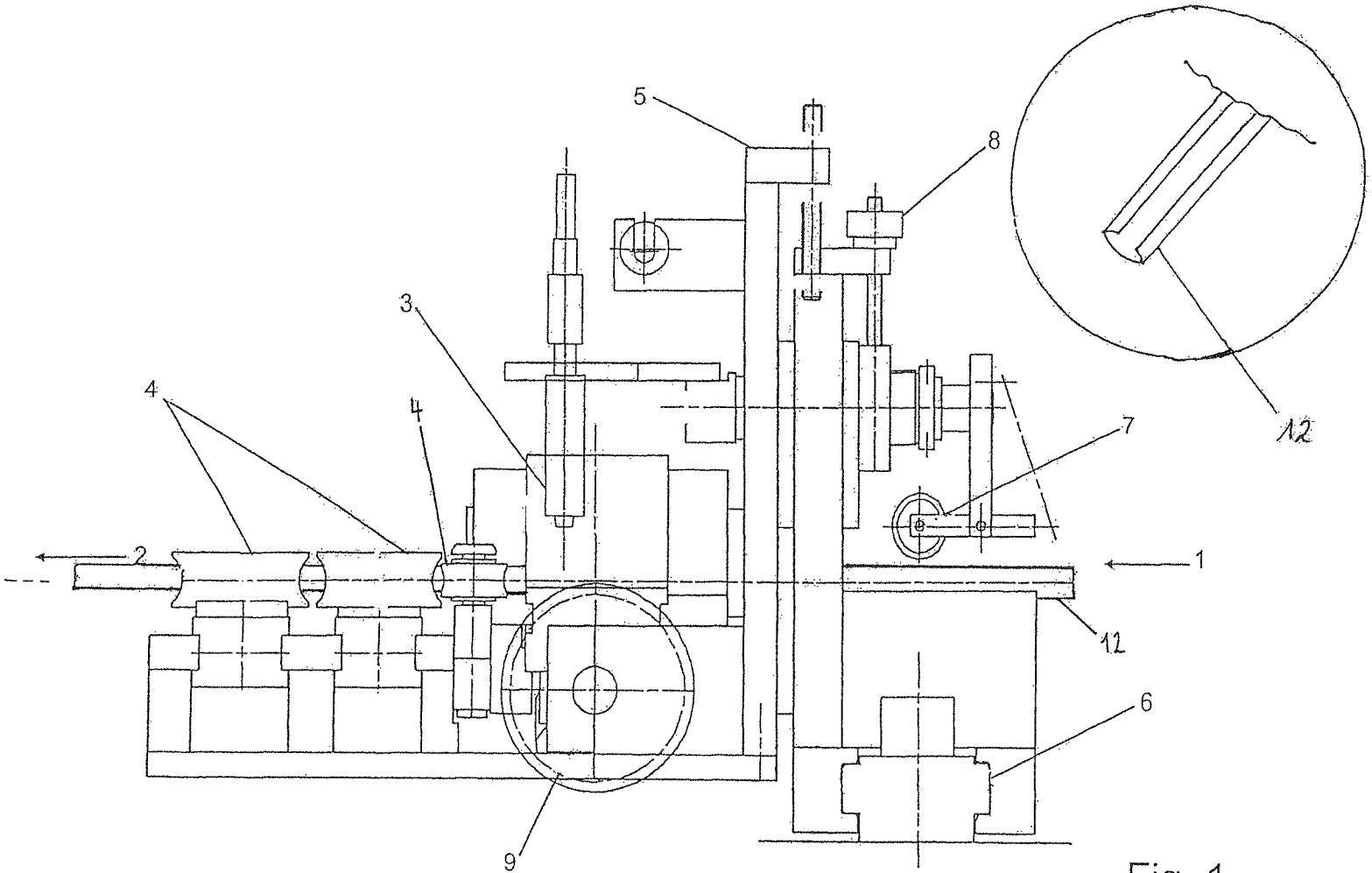
FIG. 1 is a side view of the guiding or shaping system in accordance with the present invention.

FIG. 1 shows the inventive guiding or shaping system from the side.

FIG. 1 shows the inventive guiding or shaping system from the input (1) of the slotted pipe (12) from which the opening is closed by the welding apparatus (3). The pipe, not yet cooled, is supported by the floatingly mounted lateral rolls (4) until it cools. After being cooled, the pipe is conveyed in the feed direction through and out of the output (2).

Upstream of the welding apparatus (3), the slotted pipe is compressed by the lower compression roll (9) and the right-hand and left-hand compression rolls (10). The central height adjustment adjusts the compression rolls (9 and 10) and the welding apparatus (3) as a function of the diameter of the pipe.

The optical strip edge detection system (7) controls the height adjustment (8) of the welding apparatus (3) as a function of the respective position of the strip edges.

The lateral guidance of the pipe can be adjusted via a central lateral adjustment (6).

Figure 2:
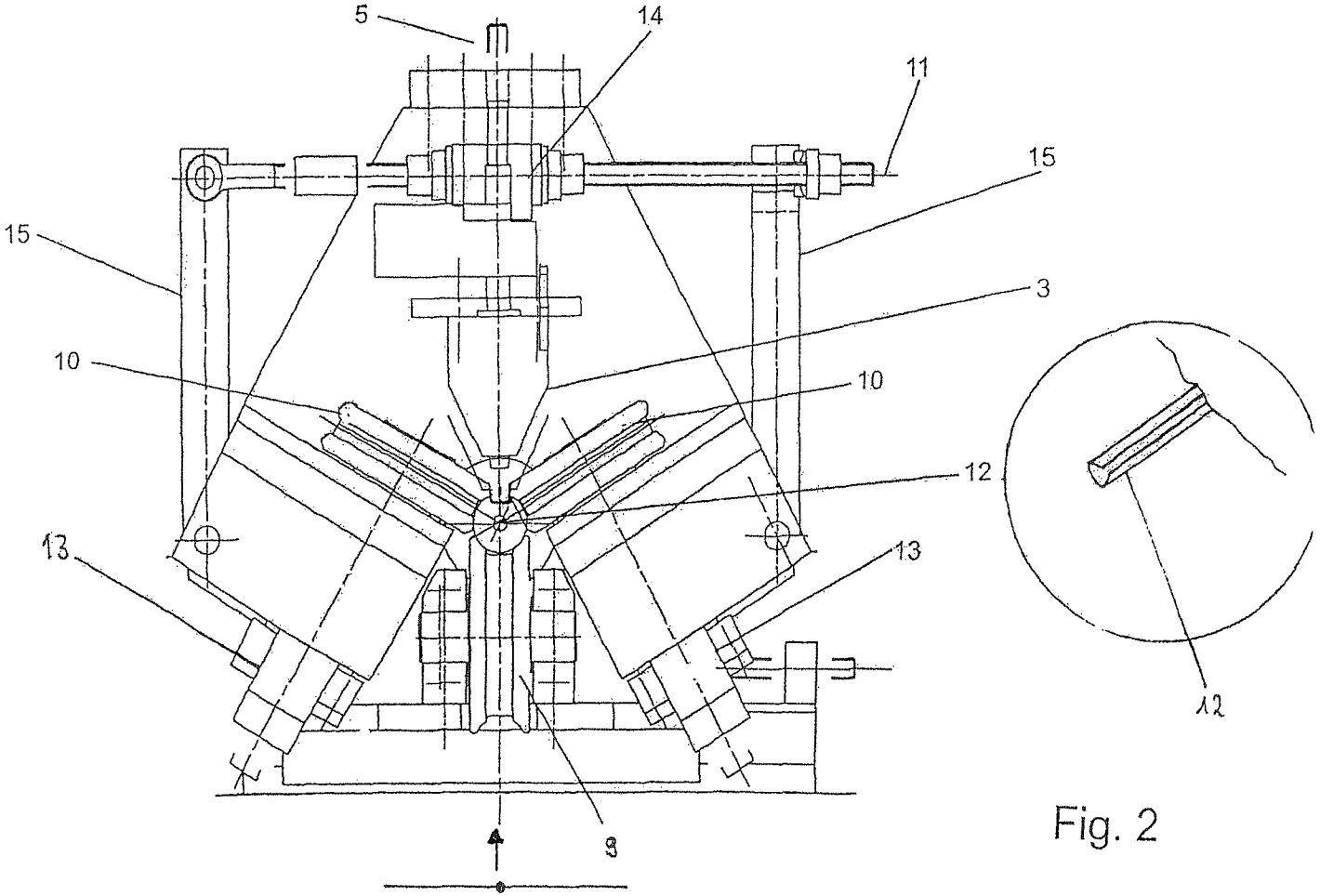
FIG. 2 is a front view of the guiding or shaping system in accordance with the present invention, shown from the input of the slotted pipe.

FIG. 2 shows the inventive guiding or shaping system from the input (1) of the slotted pipe (12) (front view).

The slotted pipe (12) is compressed by the compression rolls (9 and 10), and the open edges are closed with the aid of the welding apparatus (3). The right-hand and the left-hand compression rolls (10) can be adjusted jointly with the welding apparatus (3) via the central height adjustment (5). A fine adjustment of the compression rolls (10) is possible via the eccentric adjustment (14) via the levers (15). The lower compression roll (9) remains constant. The left-hand and right-hand compression rolls (10) can, if appropriate, have their heights adjusted separately via the adjustment (13).

Figure 3:
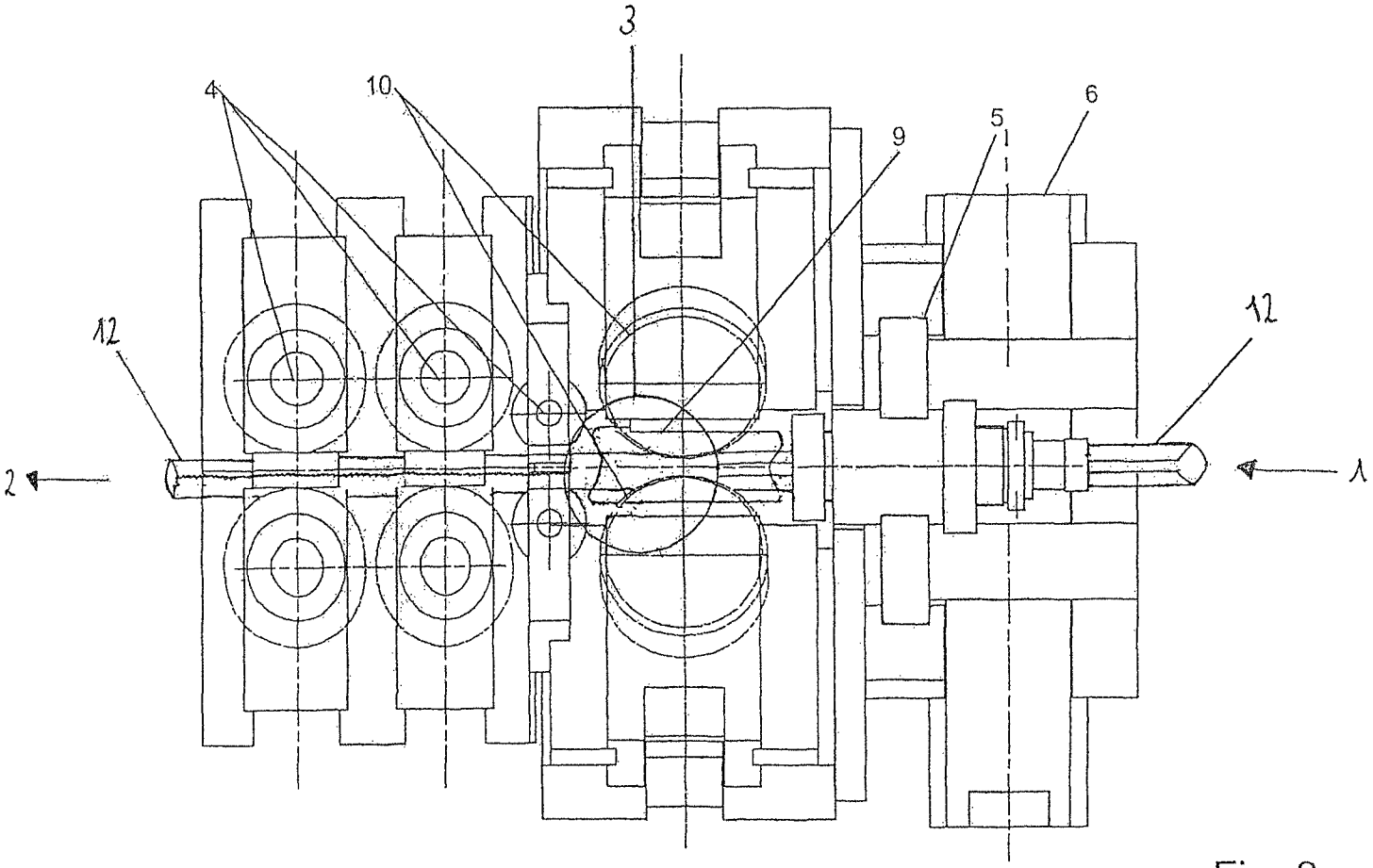
FIG. 3 is a top view of the guiding or shaping system in accordance with the present invention.

FIG. 3 shows the inventive guiding or shaping system from above.

FIG. 3 shows the inventive guiding or shaping system with the input (1) of the slotted pipe whose edges are closed by the welding apparatus (3). The tube, not yet cooled, is supported by the floatingly mounted lateral rolls (4) until it cools. After being cooled, the pipe is conveyed in the feed direction through and out of the output (2).

The right-hand and left-hand upper conversion rolls can be adjusted by the central height adjustment (5). The guidance of the slotted pipe (12) can be adjusted by the central lateral adjustment (6).

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

I claim:

1. A guiding and shaping system for producing welded pipes made from metallic strip material or sheet metal, comprising:

a number of pairs of rolls, arranged one behind another in the feed direction of a workpiece, for increasingly cold-working and bending the edges of the workpiece as it is fed;

a welding apparatus having a vertical axis;

first pairs of rolls comprising a lower compression roll and right- and left-compression rolls arranged upstream of said welding apparatus in the feed direction and configured 120° to each other relative to the vertical axis of said welding apparatus for gripping the top side and underside of the workpiece and for pressing on the outside of the workpiece for compressing the workpiece, and there being provided in the region in which the bent edges form undercuts pairs of rolls that grip the outsides of the bent edges and form the shape of a pipe;

floatingly mounted lateral rolls arranged downstream of said welding apparatus in the feed direction for supporting said workpiece after welding until said workpiece cools, wherein said floatingly mounted lateral rolls move separately relative to the workpiece and are adjusted to the workpiece separately;

a height adjustment for separately adjusting the height of said left- and right-compression rolls, said height adjustment comprising levers with predefinable bearing pressures of individual rolls for finely centrically and eccentrically adjusting the compression rolls in a vertical manner; and a strip edge detection system located upstream of said welding apparatus in the feed direction for controlling said welding apparatus in relation to the edges of the open pipe in a centric fashion relative to the pipe axis at always the same spacings from the material.

2. The guiding and shaping system according to claim 1, wherein the floatingly mounted lateral rolls are selfcentering, and no additional and undesired mechanical forces are transmitted to the welded and correspondingly heated pipe.

3. The guiding and shaping system according to claim 1, wherein said floatingly mounted lateral rolls support said workpiece until said workpiece cools to room temperature.

4. The guiding and shaping system according to claim 1, wherein before welding, a calibration apparatus adjusts and positions all the number of pairs of rolls automatically or manually.

5. The guiding and shaping system according to claim 1, wherein said strip edge detection system is selected from the group consisting of a mechanical strip edge detection system and an optical strip edge detection system.

6. The guiding and shaping system according to claim 1, wherein said floatingly mounted lateral rolls have a rotational axis that is parallel to the vertical axis of said welding apparatus.

7. A method for producing welded pipes made from metallic strip material, comprising the steps of:

providing a welding apparatus having a vertical axis;

cold-forming the initially flat strip material into a pipe in a number of forming stations lying one behind another in a conveying or feed direction, said cold-forming step being done by increasingly bending the edges of the strip material over and toward each other by compression rolls and guide rolls, wherein said compression rolls and said guide rolls are arranged upstream of said welding apparatus in the feed direction and wherein said compression rolls comprise a lower compression roll and right- and left-compression rolls configured 120° to each other relative to the vertical axis of said welding apparatus;

reducing the slot present between the edges in the further course of the feed and the shaping and finally being closed and welded; and supporting the workpiece after welding by floatingly mounted lateral rolls until said workpiece cools, wherein said floatingly mounted lateral rolls are arranged downstream of said welding apparatus in the feed direction.

8. The method according to claim 7, wherein said floatingly mounted lateral rolls are self centering.

9. The method according to claim 7, wherein said supporting step comprising supporting said workpiece by floatingly mounted lateral rolls until said workpiece cools to a temperature in the range of about 20-25° C. (68-77° F.).

10. The method according to claim 7, further comprising the step of, during cold working before welding, adjusting all the guide and compression rolls of the workpiece by a central control unit independently of the diameter of the shaped pipe.

11. The method according to claim 10, wherein the adjustment of the holding rolls and compression rolls is connected to the eccentric adjustment by levers.

12. The method according to claim 7, further comprising the steps of, before being introduced into the welding apparatus, guiding the workpiece shaped into a slotted pipe through an optical strip edge detection system, and consequently adjusting at least one of the welding head and the entire guide unit for centering the slotted pipe and can be continuously adjusted during the welding process in a fully electronic or manual fashion.

13. The method according to claim 7, further comprising the step of controlling the position of the welding torch by said mechanical or optical strip detection system.

* * * * *